US009840928B2

(12) United States Patent
Brummitt-Brown et al.

(10) Patent No.: US 9,840,928 B2
(45) Date of Patent: Dec. 12, 2017

(54) TURBINE DIAPHRAGM CONSTRUCTION

(71) Applicant: ALSTOM Technology Ltd, Baden (CH)

(72) Inventors: Angus Robert Brummitt-Brown, Warwickshire (GB); Kanu Mistry, Warwickshire (GB); Adrian Clifford Lord, Warwickshire (GB)

(73) Assignee: General Electric Technology GmbH, Baden (CH)

( * ) Notice: Subject to any disclaimer, the term of this patent is extended or adjusted under 35 U.S.C. 154(b) by 1106 days.

(21) Appl. No.: 13/863,685

(22) Filed: Apr. 16, 2013

(65) Prior Publication Data

US 2013/0287563 A1 Oct. 31, 2013

(30) Foreign Application Priority Data

Apr. 26, 2012 (EP) ..... 12165618

(51) Int. Cl.
*F01D 9/04* (2006.01)
*F01D 25/24* (2006.01)

(52) U.S. Cl.
CPC ..... *F01D 9/042* (2013.01); *F01D 25/246* (2013.01); *F05D 2220/31* (2013.01);
(Continued)

(58) Field of Classification Search
CPC ..... F01D 25/246; F01D 9/042; F01D 9/00; F01D 25/00; F05D 2220/31; F05D 2240/80; F05D 2250/314; Y10T 29/49236
(Continued)

(56) References Cited

U.S. PATENT DOCUMENTS 7,179,052 B2 * 2/2007 Sasaki ..... F01D 9/042 29/889.22
7,329,096 B2 * 2/2008 Tomko ..... F01D 9/042 415/209.4

(Continued)

FOREIGN PATENT DOCUMENTS

CN 1070029 A 3/1993
CN 201424965 Y 3/2010

(Continued)

OTHER PUBLICATIONS

European Search Report, dated Oct. 5, 2012.

*Primary Examiner* — Mark Laurenzi
*Assistant Examiner* — Paul Thiede
(74) *Attorney, Agent, or Firm* — GE Global Patent Operation; Cynthia W. Flanigan

(57) ABSTRACT

An axial flow turbine diaphragm is constructed without welding or other metal fusion or melting techniques. Static blade units are attached to inner and outer diaphragm rings by radially inner platform portions that engage the radially inner ring, and radially outer platform portions that engage the radially outer ring, the inner platform portions being elongate in the circumferential direction of the turbine diaphragm and the outer platform portions being elongate in a direction compatible with the stagger angle of the aerofoils. The outer circumference of the radially inner ring has a blade unit retaining feature of complementary shape and orientation to the inner platform portions of the static blade units, and the inner circumference of the radially outer ring is provided with a plurality of blade unit retaining features of complementary shape and orientation to corresponding outer platform portions of the static blade units.

18 Claims, 3 Drawing Sheets

(52) U.S. Cl.
CPC .... *F05D 2240/80* (2013.01); *F05D 2250/314* (2013.01); *Y10T 29/49236* (2015.01)

(58) Field of Classification Search
USPC ..... 415/209.3, 209.4; 29/889.22
See application file for complete search history.

(56) References Cited

U.S. PATENT DOCUMENTS

| | | | | |
|---|---|---|---|---|
| 2007/0086892 | A1 | 4/2007 | Tomko | |
| 2009/0191053 | A1* | 7/2009 | Bridge | F01D 5/225 415/208.2 |
| 2015/0211372 | A1* | 7/2015 | Wilson | F01D 5/147 416/241 R |

FOREIGN PATENT DOCUMENTS

| | | | |
|---|---|---|---|
| EP | 0945597 | A1 | 9/1999 |
| EP | 1408198 | A1 | 4/2004 |
| JP | 59-51197 | | 3/1984 |
| JP | 51-71901 | | 7/1993 |
| JP | 2002-47901 | | 2/2002 |
| JP | 2005-146896 | | 6/2005 |
| JP | 2005-171783 | | 6/2005 |
| JP | 2006-125282 | | 5/2006 |
| JP | 2006-329195 | | 12/2006 |
| JP | 2008-144687 | | 6/2008 |
| JP | 2008-534837 | | 8/2008 |
| JP | 2010-270717 | | 12/2010 |

* cited by examiner

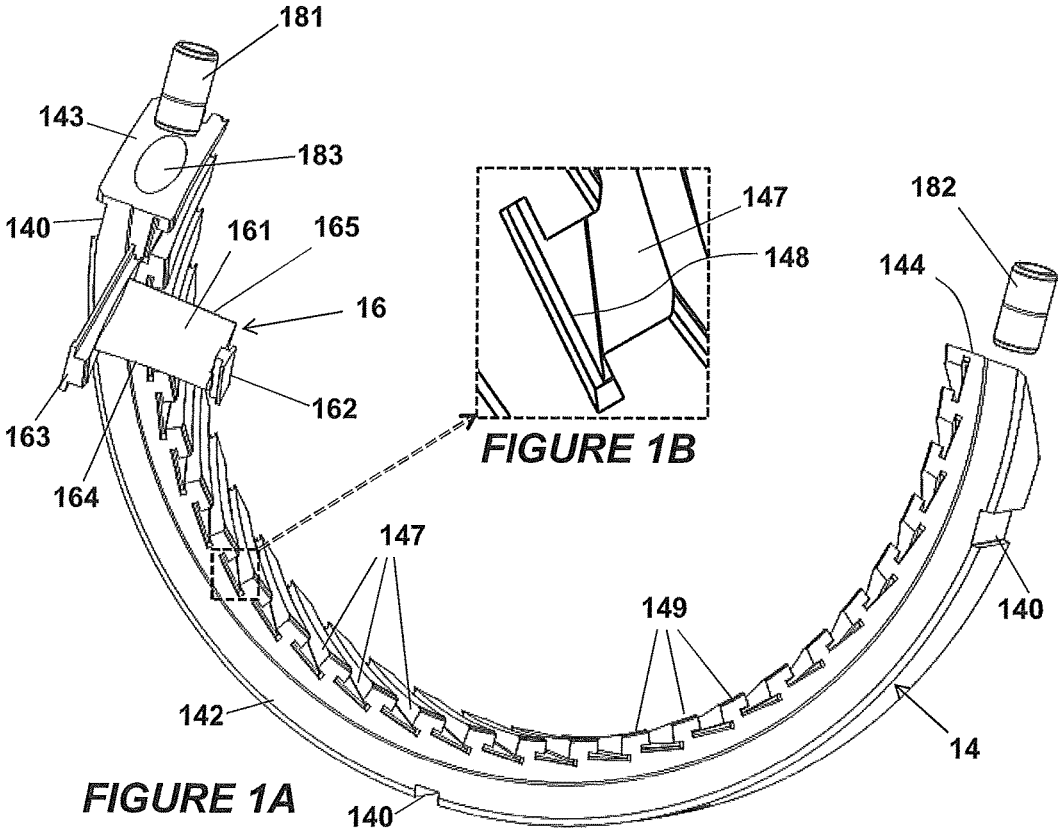
FIGURE 1B
FIGURE 1A
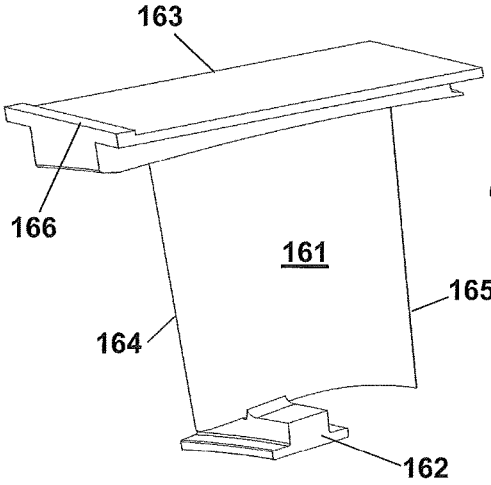
FIGURE 2A
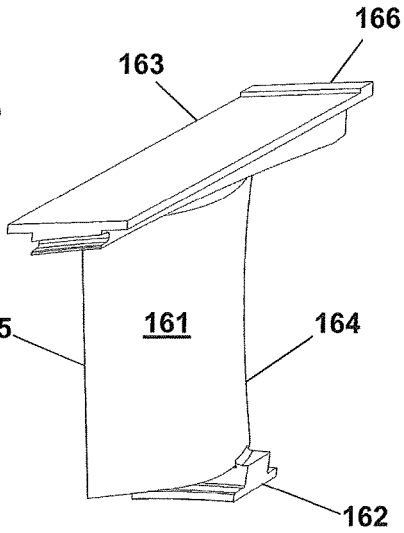
FIGURE 2B

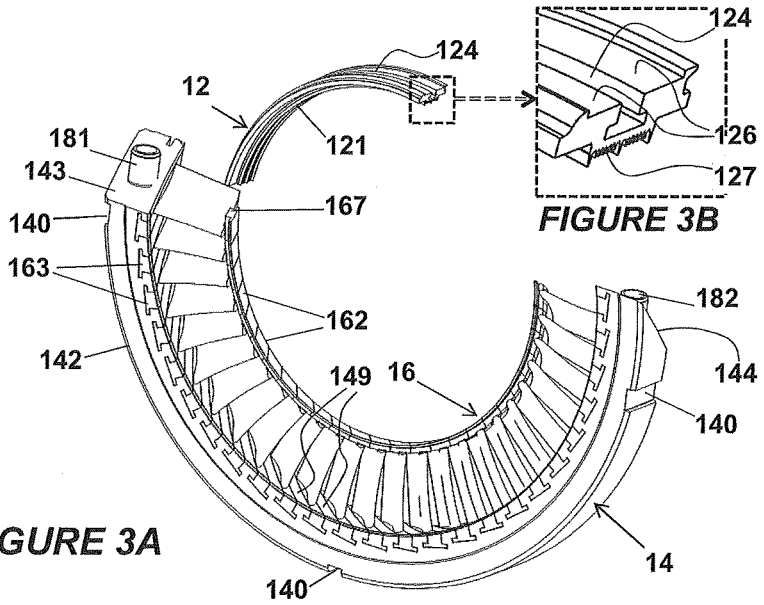
FIGURE 3A
FIGURE 3B
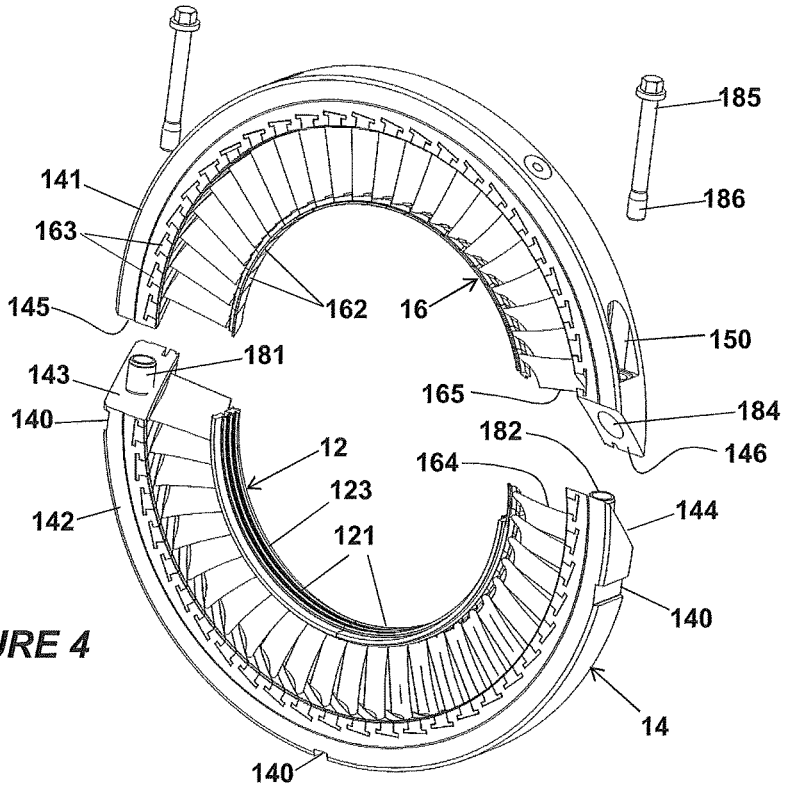
FIGURE 4

TURBINE DIAPHRAGM CONSTRUCTION

TECHNICAL FIELD

This disclosure relates to the construction of diaphragms for turbines, and in particular, to a novel structure and assembly process for diaphragms in axial flow steam turbines.

TECHNICAL BACKGROUND

A known way of constructing a steam turbine diaphragm is to mount an annulus of static guide blades between an inner ring and an outer ring. Each such blade comprises a blade unit in which an aerofoil portion extends between an inner platform and an outer platform, the blade unit being machined as a single component. This is known as the "platform" type of construction. Each platform is in the form of a segment of a cylinder so that when the annulus of blade units is assembled, the inner platforms combine to create an inner port wall and the outer platforms combine to create an outer port wall. The inner platforms are welded to an inner ring that retains the turbine blades and provides a mount for a sealing arrangement, such as a labyrinth seal, that acts between the inner ring and a rotor shaft of the turbine. The outer platforms are welded to an outer ring that provides support and rigidity to the diaphragm. Each of the inner and outer rings comprises two semi-circular halves which are joined along a plane that contains the major axis of the diaphragm and passes between blade units so that the entire diaphragm can be separated into two parts for assembly around the rotor of the turbo-machine.

Existing platform constructions for HP or IP steam turbine diaphragms generally comprise solid inner and outer rings cut from thick metal plate, or forged, or formed from bar stock. Since such rings in large turbines have substantial dimensions in the axial and radial directions of the turbine, e.g., 100 mm to 200 mm, the cost of welding together the components of the diaphragm is a significant factor in the ex-works price of a large steam turbine, not least because the necessary deep penetration welds require advanced specialist welding equipment for their production. Furthermore, welds are a possible source of metallurgical defects in the diaphragm and it is also necessary to heat treat the diaphragm in order to relieve stresses in the diaphragm caused by the welding processes.

SUMMARY OF THE DISCLOSURE

In its broadest aspect, the present disclosure provides an axial flow turbine diaphragm comprising: a radially inner diaphragm ring;

(a) a radially outer diaphragm ring;

(b) a plurality of static blade units arranged between the inner and outer rings, each blade unit comprising;
  an aerofoil portion having a stagger angle;
  a radially inner platform portion that engages the radially inner ring; and
  a radially outer platform portion that engages the radially outer ring;

wherein:

(i) the radially inner ring is provided with blade unit retaining means operative to retain the inner platform portions to the inner ring;

(ii) the outer platform portion is elongate in a direction compatible with the stagger angle of the aerofoil; and (iii) an inner circumference of the radially outer ring is provided with a plurality of blade unit retaining features, each such feature being of complementary shape and orientation to a corresponding outer platform portion of a static blade unit, and operative to retain the outer platform portion to the radially outer ring.

Note that the radially outer diaphragm ring includes the radially outer platform portions of the blade units as part of its structure. Thus, the present concept produces a diaphragm structure in which a radially outer port wall of the diaphragm comprises the radially outer platform portions, alternating in the circumferential direction with exposed portions of the inner circumference of the outer diaphragm ring.

The above construction enables the components of the diaphragm to be assembled and held together solely by mechanical means, i.e., the diaphragm can be constructed without welding or other metal melting techniques.

In a preferred embodiment, the radially inner platform portions of the blade units are elongate in the circumferential direction of the turbine diaphragm and an outer circumference of the radially inner ring is provided with a blade unit retaining feature of complementary shape and orientation to the inner platform portions of the static blade units, whereby the inner platform portions are retained to the radially inner ring. Hence, in this embodiment, the radially inner diaphragm ring includes the radially inner platform portions of the blade units as part of its structure. Thus, the radially inner port wall of the diaphragm will comprise the radially inner platform portions, flanked on their axially opposed (inlet and outlet) sides by exposed portions of the outer circumference of the inner diaphragm ring.

The preferred construction enables the components of the diaphragm to be assembled and held together solely by mechanical interlocking of its components.

To maintain aerodynamic smoothness, confronting ends of the radially inner elongate platform portions should preferably butt up to each other when inserted into the blade unit retaining feature of the inner ring, such that the platform portions extend continuously around the inner port wall of the diaphragm in the circumferential direction.

Clearly, with regard to their dimensions and surface finishes, the platform portions of the blade units and the blade retaining features of the inner and outer rings should be accurately manufactured and closely matched to each other, so that the inner and outer port walls of the diaphragm are sufficiently smooth to avoid excessive aerodynamic drag penalties.

To properly secure the blade units to the inner and outer diaphragm rings, the radially inner platform portions and the radially outer platform portions of the blade units have radial cross-sections shaped to fit blade unit retaining features in the form of slots or grooves having radial cross-sections with undercut or re-entrant shapes, such as dovetails. In a preferred embodiment, the radially inner and outer platform portions of the blade units are T-shaped in cross-section; for the inner platform portions the cross-bar of the T-shape is positioned radially inwards of the stem of the T-shape, whereas for the outer platform portions, the cross-bar of the T-shape is positioned radially outwards of the stem of the T-shape.

The radially inner and outer diaphragm rings may each comprise at least two segments. Preferably, the inner diaphragm ring has an even number of segments comprising at least four segments and the outer diaphragm ring is preferably constructed as two segments that upon assembly are united with each other on joint planes at diametrically opposed sides of the outer diaphragm ring. To avoid the joint planes cutting across the blade unit retaining features in the outer diaphragm ring, the joint planes are pitched at a scarf angle that is the same or closely similar to the stagger angle of the aerofoils.

The segments of the outer diaphragm ring may be united with each other by bolted joints.

Preferably, either the radially outer platform portions of the blade units, or the blade unit retaining features of the outer ring, or both, are provided with stop features operative against movement of the platform portions relative to the retaining features under the influence of a pressure difference across the diaphragm.

Further aspects of the present concept will become apparent from a study of the following description and the appended claims.

BRIEF DESCRIPTION OF THE DRAWINGS

Embodiments of the concept disclosed herein will now be described, with reference to the accompanying drawings, in which:

FIG. 1A is a three-dimensional perspective view of an embodiment of the present concept, showing the lower half of the outer ring of an HP or IP steam turbine diaphragm in an initial stage of assembly;

FIG. 1B is an enlarged view of part of FIG. 1A;

FIG. 2A is a three-dimensional perspective view on the pressure side of a blade unit ready for incorporation into the steam turbine diaphragm of FIG. 1;

FIG. 2B is a view of the suction side of the blade unit of FIG. 2A;

FIGS. 3A, 4 and 5 are views showing further stages in the assembly of the HP or IP steam turbine diaphragm, FIG. 3B is an enlarged view of part of FIG. 3A.

The drawings are not to scale.

DETAILED DESCRIPTION OF PREFERRED EMBODIMENTS

Figure 5:
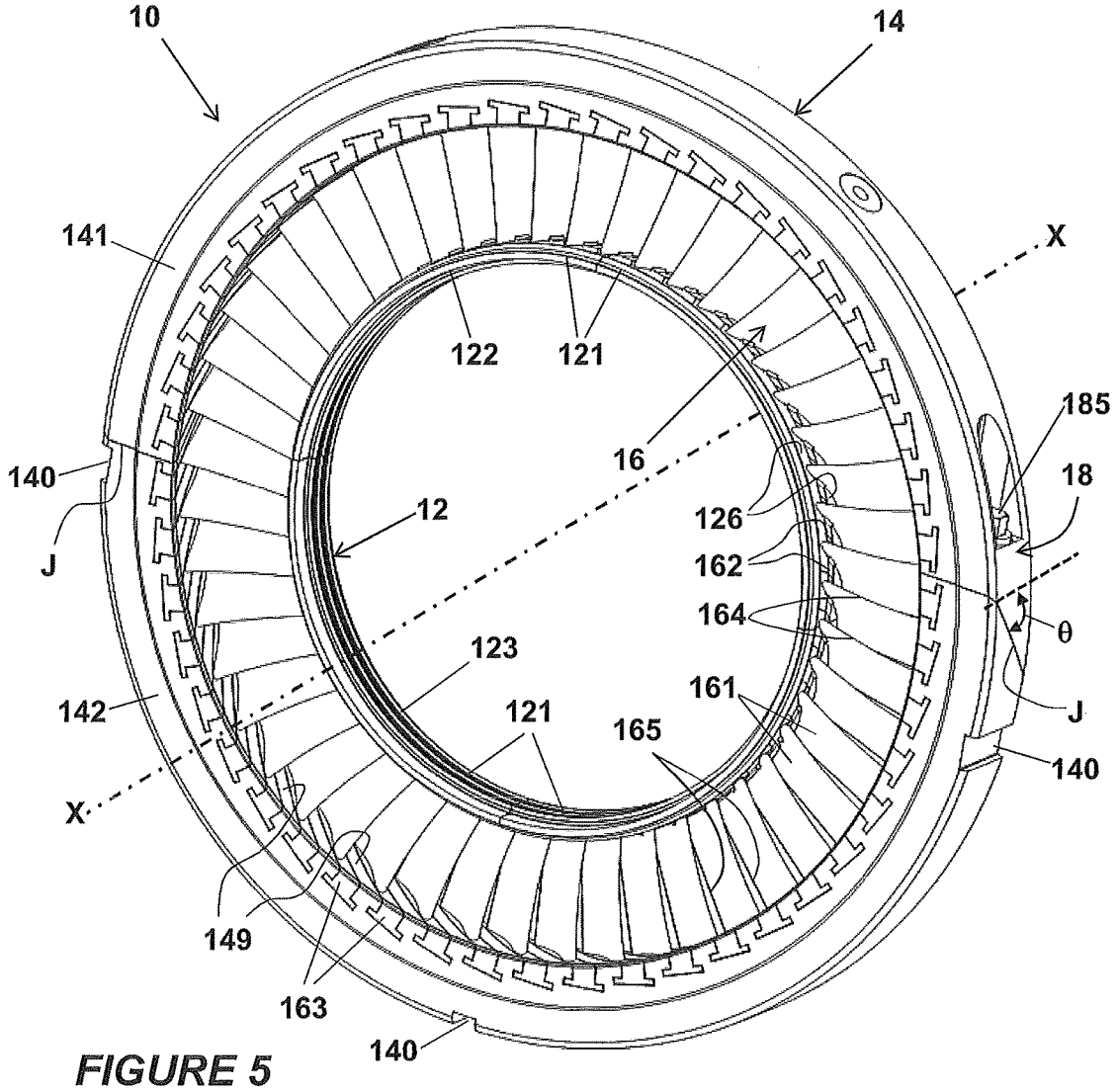

Steam turbine diaphragms are normally constructed by welding their components together, but in accordance with the present concept, FIGS. 1A, 3A, 4 and 5 show a high pressure steam turbine diaphragm 10 and which is constructed without welding or other fusion or adhesive metal joining techniques. Referring first to FIG. 5, which shows the diaphragm after it has been assembled having a major axis X-X, the diaphragm 10 comprises a radially inner diaphragm ring 12, a radially outer diaphragm ring 14 and an annular array of static blade units 16 arranged between the inner and outer rings. The illustrated embodiment is a diaphragm with a radially compact type of construction, which has a much reduced radial thickness of its inner diaphragm ring 12 compared with the more robust type of construction traditionally used for large steam turbines. In fact, as will be apparent from the description below, the inner diaphragm ring 12 of the illustrated embodiment is effectively part of all the inner platform port wall surfaces of the static blade units 16. However, the concept discussed herein is also applicable to diaphragms having inner rings which are radially thicker than the one illustrated and/or which do not form part of the inner platform surfaces.

To enable assembly of the diaphragm into a turbine, the outer ring 14 is constructed in two segments, an upper half 141 and a lower half 142, the two segments being united with each other at joint planes J. Of course, the number of segments in the outer ring 14 is at the option of the designer, consistent with requirements for cost-effective manufacture and assembly of the diaphragm 10. In the illustrated embodiment, the joint planes J exhibit a scarf angle θ, i.e., they are inclined away from alignment with the axial direction of the assembly (the axial direction being defined by reference to the major axis X-X of the diaphragm), as explained later, and the joint is bolted at 18 on diametrically opposite sides of the outer ring 14.

Returning to FIG. 1A, bolt guide spacers 181, 182 are shown poised for insertion into bores 183 in planar joint faces 143, 144 of the lower half 142 of the outer diaphragm ring 14. Each bolt guide spacer 181, 182 essentially comprises a dowel having a bore which will allow the bolts of the bolted joint 18 to pass through it, and an external diameter which allows a push-fit into the bore 183. The bolt guide spacers 181, 182 are necessary because of the scarf angle of the joint faces.

As shown in FIG. 4, each planar joint face 143, 144 mates with a complementarily inclined planar joint face 145, 146 on the upper half 141 of the outer ring 14, and a projecting part of each bolt guide spacer 181, 182 fits inside a complementarily dimensioned bore 184 in the upper half 141 of the outer ring 14. Note that the outer circumference of the upper half 141 of the outer ring 14 is specially recessed at 150 on opposite sides of the ring 14 to allow insertion of bolts 185 into the bores, which run tangentially of the ring. Only a distal end portion 186 of each bolt 185 is provided with a screw thread, which screws into a complementarily threaded portion of each bore 183 in the lower half 142 of outer ring 14.

When installed in the turbine, the bottom half of the outer ring (and hence the entire diaphragm) is supported within a surrounding turbine casing (not shown) by means of cross-key location features 140, as known in the industry.

Referring again to FIG. 1A, a blade unit 16 is shown poised for insertion into the lower half 142 of the outer ring 14. Each blade unit comprises an aerofoil portion 161, an inner platform portion 162 that engages the radially inner ring 12, and an outer platform portion 163 that engages the radially outer ring 14. To enable locking together of the components of the diaphragm without the use of welding or other fusion or adhesive metal-joining techniques, the inner platform portion 162 is elongate in the circumferential direction of the inner ring 12, whereas the outer platform portion 163 is elongate in a direction which is generally transverse of the inner platform portion and compatible with the stagger angle of the blade aerofoils. Hence, when the diaphragm is fully assembled, the inner and outer platform portions 162, 163 are effectively cross-keyed relative to each other in the inner and outer rings 12 and 14 respectively, thus stabilising the blade units 16 within the diaphragm structure.

To retain the outer platform portions 163 of the static blade units 16 in engagement with the outer ring 14, an inner circumference of the radially outer ring is provided with blade unit retaining features 147 in the form of an array of angularly spaced-apart slots, each slot 147 being of complementary shape to the corresponding outer platform portion 163 of a static blade unit 16. In the illustrated embodiment, the outer platform portions 163 are T-shaped in cross-section, as shown more clearly in FIG. 2A. As will be more clearly seen from FIG. 1B, the slots 147 are also T-shaped, so that each T-shaped platform portion 163 fits inside an equivalent T-shaped slot 147 in the inner circumference of the radially outer ring 14.

It should be understood that the slots 147 and the outer platform portions 163 of the static blade units 16 could be other than T-shaped in cross-section, e.g., dove-tail shaped or some other undercut or re-entrant shape that securely retains the blade units in an interlocking manner. It should also be appreciated that the slots 147 and the outer platform portions 163 of the static blade units 16 are oriented to match, or closely approximate, the stagger angle of the aerofoils 161. Hence, the planar joint faces 143 to 146 must be pitched at the same or a closely similar angle to the stagger angle in order to avoid the joint planes J (FIG. 5) cutting across any of the slots 147 in the outer ring 14.

Referring to FIGS. 1 and 5, when the fully constructed diaphragm is part of a functioning turbine, the edges 164 of the aerofoils 161 will be their leading edges at the steam inlet side of the diaphragm and the edges 165 will be their trailing edges at the steam outlet side of the diaphragm. Hence, there will be a pressure drop across the diaphragm in the axial direction from the leading edges to the trailing edges of the aerofoils 161. To secure the outer platform portions 163 of the static blade units 16 against movement in the slots 147 under the influence of the pressure difference between the inlet and outlet sides of the diaphragm, a stop feature 166 is provided at the inlet end of each outer platform portion 163. In the illustrated embodiment, the stop feature 166 is in the form of a step that projects radially outwards of the rest of the platform portion 163 and fits into a matching complementary step 148 (FIG. 1B) cut into the inlet end of the slots 147. Alternative stop features could be used; e.g., a step at the outlet end of the slot 147, the step projecting radially inwards of the radially outer part of the slot and fitting into a matching complementary step cut into the outlet end of the outer platform portion 163.

Returning to a consideration of FIG. 5, whereas the outer ring 14 comprises two segments in the form of upper and lower half rings 141, 142, the inner ring 12 comprises four segments, each of ninety degrees of arc, i.e., two segments 121 in the upper half 122 of the inner ring and two segments 121 in the lower half 123 of the inner ring. Although in the illustrated embodiment, the inner ring 14 is made up of four segments to make assembly easier, it would also be possible for the inner ring to comprise only two segments, namely an upper half 122 and a lower half 123. The number of segments in the inner ring 12 is at the option of the designer, consistent with requirements for cost-effective manufacture and assembly of the diaphragm 10.

Turning now to FIG. 3A, a segment 121 of the inner ring 12 is shown poised for attachment to the inner platform portions 162 of an assembled half ring of the static blade units 16. Each segment 121 has a blade unit retaining feature in the form of a circumferentially extending slot 124 in the outer circumference of the segment. Attachment of segment 121 to the inner platform portions 162 is achieved by sliding the slot 124 in segment 121 onto the inner platform portions 162 of the static blade units 16, the slot 124 being complementary in shape to the inner platform portions 162. In the illustrated embodiment, the inner platform portions 162 are T-shaped in cross-section, as shown more clearly in FIGS. 2A and 2B, so that each T-shaped platform portion 162 fits inside the T-shaped slot 124 in the outer circumference of the inner ring 12, the slot 124 being shown more clearly in FIG. 3B.

It should be understood that the slot 124 and the inner platform portions 162 of the static blade units 16 could be other than T-shaped in cross-section, e.g., dove-tail shaped or some other undercut or re-entrant shape that securely retains the blade units in an interlocking manner.

Figure 6:
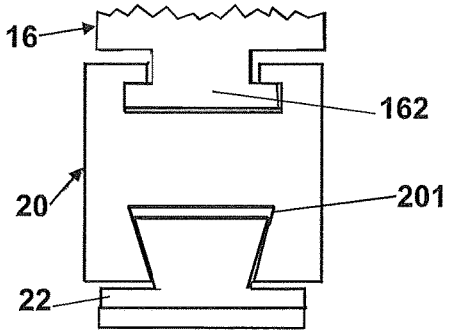
FIG. 6 is a diagrammatic representation of a further embodiment of the present concept.

In the radially compact embodiment of FIG. 3B, the radially inner side of each segment 121 of the radially inner ring 12 is configured as a labyrinth seal 127 for sealing directly against a rotor when the diaphragm has been assembled into a turbine, the seal being necessary to restrict leakage between relatively high and low pressure sides of the diaphragm. However, in less radially compact constructions, it is conventional for the radially inner side of a radially inner diaphragm ring to comprise a circumferentially extending recess configured to retain a separate seal therein, as shown diagrammatically in FIG. 6, which represents a fragmentary radial section through an inner ring 20 that is radially thicker than the inner ring 12, and therefore can carry segments of a separately formed labyrinth seal 22 in a dovetail-shaped slot 201 or other undercut or re-entrant shape machined in its radially inner side, the radially outer side of the inner ring 20 being engaged by the inner platform portions 162 of the static blade units 16, as previously described. As well known in the industry, other types of seal, such as brush or leaf seals, may be substituted for the labyrinth seal, and/or provision may be made for the seal to be spring-mounted in the slot 201, so that it can automatically adjust to variations in the clearance between the inner ring 20 and the rotor surface (not shown) against which the seal acts.

In the traditional type of platform construction for steam turbine diaphragms, the blade units are machined as single components complete with aerofoils and inner and outer platforms, so that when the platforms are welded onto their respective inner and outer rings, the inner platforms combine to create an inner port wall and the outer platforms combine to create an outer port wall. It will be appreciated from the drawings and the above description that the present concept for platform construction is distinct from the traditional type, in that the inner and outer blade platforms are reduced to elongate attachment features 162, 163 that are retained in complementary-shaped blade-retaining features 124, 147 provided in the inner and outer diaphragm rings 12, 14. In the assembled diaphragm 10, the radially outer platform portions 163 of the blade units 16 are elongate in directions compatible with the stagger angle of the blade aerofoils 161, whereas the radially inner platform portions 162 of the blade units 16 are elongate in the circumferential direction of the inner ring 12. In the embodiment of the present concept illustrated in FIG. 5, the radially outer port wall of the diaphragm comprises the radially outer elongate platform portions163 of the blade units 16, alternating in the circumferential direction with exposed portions 149 of the inner circumference of the outer diaphragm ring 14. In contrast, the radially inner port wall of the diaphragm 10 comprises the radially inner elongate platform portions 162 of the blade units 16, flanked on their axially opposed (inlet and outlet) sides by exposed portions 126 (see also FIG. 3B) of the outer circumference of the inner diaphragm ring 12. The ends of the elongate platform portions 162 butt up to each other when inserted into the inner ring 12, so that the platform portion 162 extend continuously around the inner port wall in the circumferential direction, as do the exposed portions 126 of the inner diaphragm ring 12.

It is important that the inner and outer port walls of the diaphragm are sufficiently smooth to avoid excessive aerodynamic drag penalties, and to this end the platform portions of the blade units and the blade retaining features of the inner and outer rings should be accurately manufactured and closely matched to each other with regard to their dimensions and surface finishes.

A sequence of assembly of the diaphragm 10 will now be described with reference to the Figures.

(a) The individual components of the diaphragm 10 are produced to final shape before assembly.

(b) As shown in FIG. 1A for the lower half 142 of the outer diaphragm ring 14, the static blade units 16 are attached to the upper and lower halves of the outer ring 14 by sliding the outer platform portions 163 of the blade units fully into the slots 147 in the inner circumference of the outer ring.

(c) Either before or after insertion of the blade units 16 into the outer ring 14, the bolt guide spacers 181, 182 may be inserted into the bores 183 in the lower half 142 (or upper half 141) of the outer diaphragm ring 14.

(d) As illustrated in FIG. 3A for the lower half 142 of the outer ring 14, when all the static blade units 16 are attached to one of the half rings, their inner platform portions 162 form a continuous circumferentially extending track, ready to receive the segments 121 of the inner ring 12. Hence, the next stage of assembly is to attach the four segments 121 of the inner diaphragm ring 12 to the blade units 16 by sliding the T-shaped slot 124 in the outer circumference of the segments onto the T-shaped inner platform portions 162 of the blade units 16. When the lower and upper halves of the inner ring have been attached to the inner platform portions 162 of the blade units 16, sliding of the segments 121 relative to the inner platform portions 162 is prevented by inserting anti-rotation stop features (not shown) at the ends of the segments. Such stop features could for example comprise a step at the end of the slot 124, which—when the segment 121 in FIG. 3A has been fully pushed onto the inner platform portions 162—butts up against an end face 167 of the platform portion nearest the joint between the top and bottom halves of the diaphragm.

(e) After building up both the top and the bottom halves of the diaphragm 10 independently of each other, they can be joined together as indicated in FIG. 4 by sliding the bores 184 in the top half 141 of the outer ring 141 onto the bolt guide spacers 181, 182, then inserting the bolts 185 into the bores 184, passing them through the hollow bolt guide spacers and into the bores 183 in the bottom half 142 of the outer ring 141, and finally screwing the bolts fully home into the bottom threaded portions (not shown) of bores 183.

(f) FIG. 5 shows the fully assembled diaphragm 10, which can easily be split into two halves for assembly into the turbine by removing the bolts 185.

Adoption of the concept proposed herein confers the following advantages.

The need for welding or other metal melting techniques in the construction of the diaphragm is completely eliminated, with consequent saving of costs and reduced manufacturing time.

Elimination of welding eliminates a possible source of defects in the structure of the diaphragm.

The type of welding normally used in the construction of diaphragms normally comprises deep penetration welds requiring advanced and expensive laser or electron beam welding equipment. Elimination of welding therefore allows more choice in the selection of production facilities for construction of turbine diaphragms.

The above embodiments have been described above purely by way of example, and modifications can be made within the scope of the appended claims. Thus, the breadth and scope of the claims should not be limited to the above-described exemplary embodiments. Each feature disclosed in the specification, including the claims and drawings, may be replaced by alternative features serving the same, equivalent or similar purposes, unless expressly stated otherwise.

For example, it is possible to envisage a diaphragm construction in which radially inner platform portions of the static blade units are retained to an inner diaphragm ring by means of bolts, or the like, instead of by an interlocking arrangement as described above.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An axial flow turbine diaphragm comprising:

(a) a radially inner diaphragm ring having a circumferential direction;

(b) a radially outer diaphragm ring having a circumferential direction;

(c) a plurality of static blade units arranged between the radially inner diaphragm ring and the radially outer diaphragm ring, each static blade unit of the plurality of static blade units comprising:

an aerofoil portion;

a radially inner platform portion that engages the radially inner diaphragm ring; and a radially outer platform portion that engages the radially outer diaphragm ring; wherein:

(i) the radially inner diaphragm ring is provided with blade unit retaining means that retains the radially inner platform portions to the radially inner diaphragm ring;

(ii) the radially outer platform portion includes a length and a width, the length being greater than the width, and the length being disposed on the radially outer diaphragm ring so as to elongate in a direction oriented to match a placement direction of the aerofoil portion that is generally transverse to the circumferential direction of the radially outer diaphragm ring; and (iii) an inner circumference of the radially outer diaphragm ring is provided with a plurality of blade unit retaining features, each blade unit retaining feature being of complementary shape and orientation to the corresponding radially outer platform portion of the each static blade unit of the plurality of static blade units, thereby to retain the radially outer platform portion to the radially outer diaphragm ring, wherein the radially inner platform portion of each of the plurality of static blade units includes a length and a width, the length of the radially inner platform portion being greater than the width of the radially inner platform portion, and the length of the radially inner platform portion being disposed on the radially outer diaphragm ring so as to elongate in the circumferential direction of the radially inner diaphragm ring, and wherein the length of the radially outer platform portion of each of the plurality of static blade units is elongate in a direction transverse to the length of the radially inner platform portion.

2. The axial flow turbine diaphragm according to claim 1, in which the radially outer platform portions of the plurality of static blade units alternate in the circumferential direction with exposed portions of the inner circumference of the radially outer diaphragm ring.

3. The axial flow turbine diaphragm according to claim 1, in which the radially inner platform portions of the plurality of static blade units are elongate in the circumferential direction of the axial flow turbine diaphragm and an outer circumference of the radially inner diaphragm ring is provided with a blade unit retaining feature of complementary shape and orientation to the radially inner platform portions of the plurality of static blade units, whereby the radially inner platform portions are retained to the radially inner diaphragm ring.

4. The axial flow turbine diaphragm according to claim 3, in which the radially inner platform portions of the plurality of static blade units are flanked on axially opposed sides of the radially inner platform portions by exposed portions of the outer circumference of the radially inner diaphragm ring.

5. The axial flow turbine diaphragm according to claim 3, in which confronting ends of the radially inner platform portions butt up to each other when inserted into the blade unit retaining means of the radially inner diaphragm ring, such that the radially inner platform portions extend continuously around the outer circumference of the radially inner diaphragm ring of the axial flow turbine diaphragm in the circumferential direction.

6. The axial flow turbine diaphragm according to claim 1, in which the radially inner platform portions and the radially outer platform portions of the plurality of static blade units have radial cross-sections shaped to fit the blade unit retaining features in the form of slots or grooves having radial cross-sections with undercut or re-entrant shapes.

7. The axial flow turbine diaphragm according to claim 6, in which the radially inner platform portions of the plurality of static blade units are T-shaped in cross-section, the cross-bar of the T-shape being positioned radially inwards of the stem of the T-shape.

8. The axial flow turbine diaphragm according to claim 6, in which the radially outer platform portions of the plurality of static blade units are T-shaped in cross-section, the cross-bar of the T-shape being positioned radially outwards of the stem of the T-shape.

9. The axial flow turbine diaphragm according to claim 1, in which the radially inner diaphragm ring and the radially outer diaphragm ring each comprises at least two segments.

10. The axial flow turbine diaphragm according to claim 9, in which the radially inner diaphragm ring has an even number of segments comprising at least four segments.

11. The axial flow turbine diaphragm according to claim 10, wherein each of the at least four segments of the radially inner diaphragm ring comprises an arc of ninety degrees.

12. The axial flow turbine diaphragm according to claim 9, in which the segments of the radially outer diaphragm ring are united with each other on joint planes at diametrically opposed sides of the radially outer diaphragm ring.

13. The axial flow turbine diaphragm according to claim 9, in which the segments of the radially outer diaphragm ring are united with each other on joint planes that are angled to be compatible with the direction of the aerofoil portions of the plurality of static blade units.

14. The axial flow turbine diaphragm according to claim 9, in which the segments of the radially outer diaphragm ring are united with each other by bolted joints.

15. A method of assembling the axial flow turbine diaphragm of claim 9, comprising the steps of:

(a) attaching the plurality of static blade units to the segments of the radially outer diaphragm ring by sliding the radially outer platform portions of the plurality of static blade units into the blade unit retaining features in the inner circumference of the segments of the radially outer diaphragm ring, each such segment having a plurality of static blade units attached thereto;

(b) attaching the segments of the radially inner diaphragm ring to the radially inner platform portions of the plurality of static blade units, the plurality of the static blade units attached to the segments of the radially outer diaphragm ring, by sliding the blade unit retaining means of the radially inner diaphragm ring onto the radially inner platform portions of the plurality of static blade units, the segments of the radially outer diaphragm ring having the plurality of static blade units and at least one segment of the radially inner diaphragm ring attached thereto; and (c) completing assembly of the axial flow turbine diaphragm by joining together the separate segments of the radially outer diaphragm ring with the plurality of static blade units and the segments of the radially inner diaphragm ring attached thereto.

16. The axial flow turbine diaphragm according to claim 1, in which the radially outer platform portions of the plurality of static blade units and/or the blade unit retaining features of the radially outer diaphragm ring are provided with stop features operative against movement of the radially outer platform portions relative to the blade unit retaining features of the radially outer diaphragm ring under the influence of a pressure difference across the axial flow turbine diaphragm.

17. The axial flow turbine diaphragm according to claim 1, in which the radially inner side of the radially inner diaphragm ring is configured as a seal, or is configured to retain a seal, the seal being operative to restrict leakage between relatively high and low pressure sides of the axial flow turbine diaphragm.

18. The axial flow turbine diaphragm according to claim 1, in which the radially inner platform portions of the plurality of static blade units and the radially outer platform portions of the plurality of static blade units are cross-keyed relative to each other in the radially inner diaphragm ring and the radially outer diaphragm ring, respectively.

* * * * *